United States Patent [19]

Bresee, Jr. et al.

[11] 4,011,789

[45] Mar. 15, 1977

[54] GUN FIRE CONTROL SYSTEM

[75] Inventors: Louis B. Bresee, Jr., So. Burlington; Charles A. Brownlee, Essex Junction; Robert A. Leightner, Burlington, all of Vt.

[73] Assignee: General Electric Company, Burlington, Vt.

[22] Filed: May 6, 1974

[21] Appl. No.: 467,529

[52] U.S. Cl. ..... 89/41 EA; 235/61.5 E; 356/4

[51] Int. Cl.[2] ..... F41G 3/02

[58] Field of Search ..... 89/41 E, 41 EA, 41 AA, 89/41 L; 235/61.5 E, 61.5 DF, 61.5 S; 356/4

[56] References Cited

UNITED STATES PATENTS 3,766,826 10/1973 Salomonsson ..... 89/41 L

*Primary Examiner*—Stephen C. Bentley
*Attorney, Agent, or Firm*—Bailin L. Kuch

[57] ABSTRACT

A fire control system is provided utilizing a laser range finder mounted directly on the gun turret.

5 Claims, 1 Drawing Figure

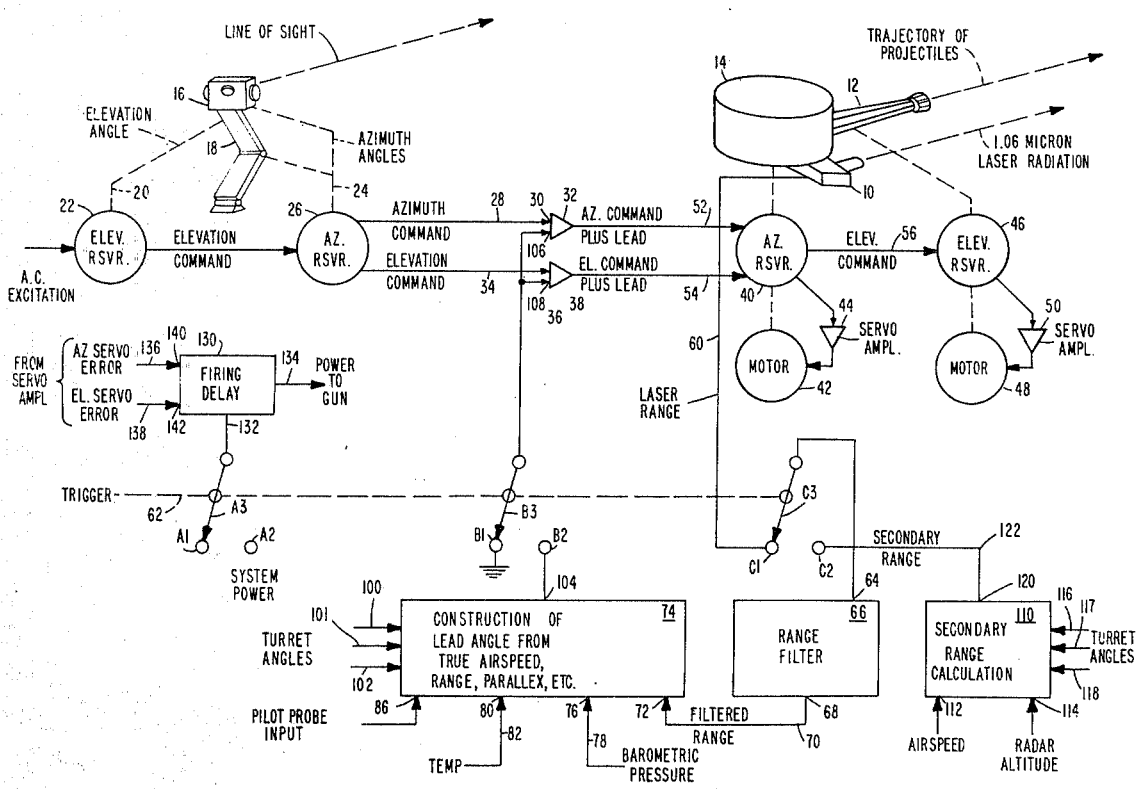

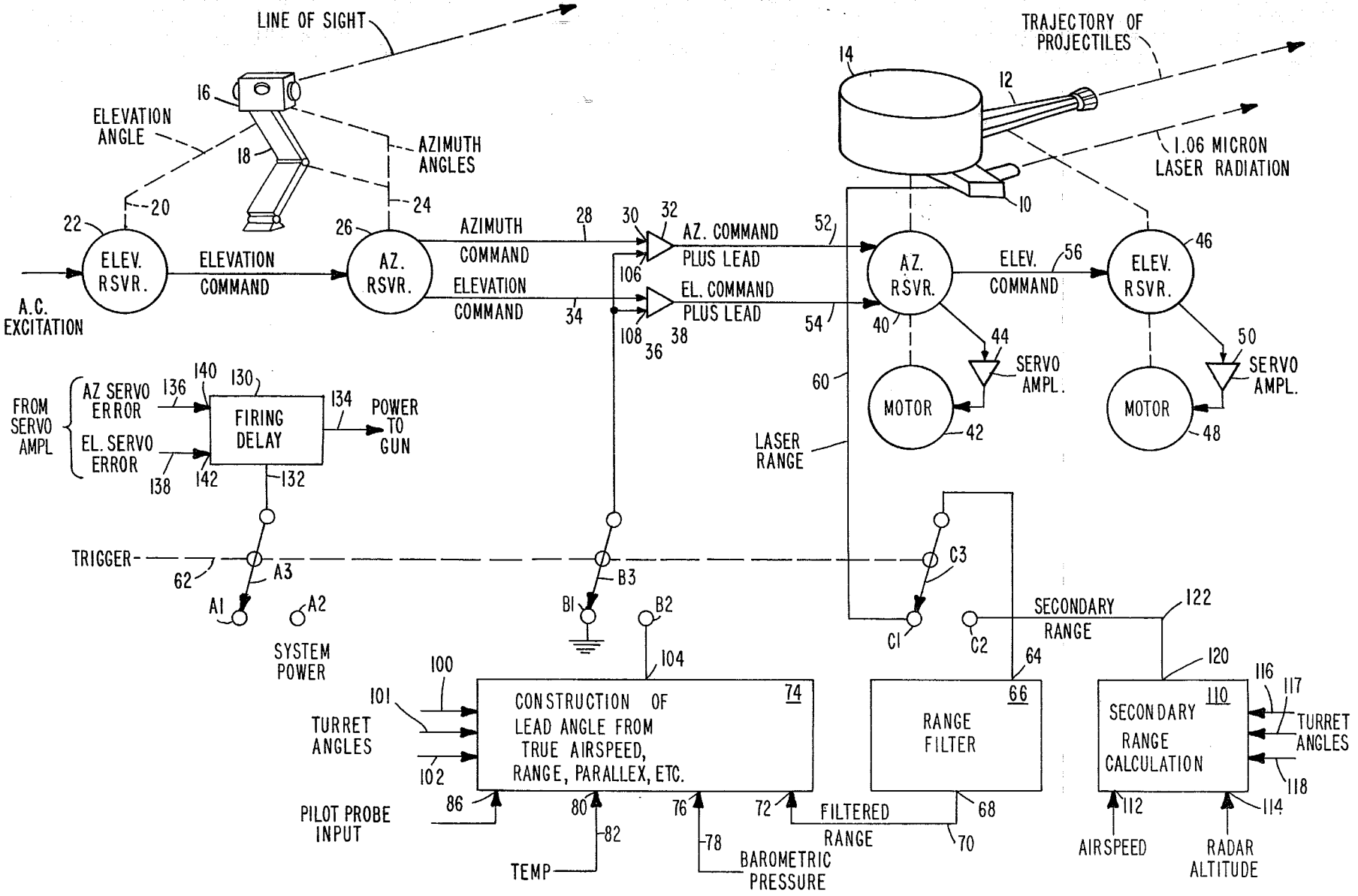
TRAJECTORY OF PROJECTILES
1.06 MICRON LASER RADIATION
SERVO AMPL.
ELEV. RSVR.
MOTOR
ELEV. COMMAND
AZ. RSVR.
LASER RANGE
SECONDARY RANGE
SECONDARY RANGE CALCULATION
TURRET ANGLES
RADAR ALTITUDE
AIRSPEED
RANGE FILTER
FILTERED RANGE
BAROMETRIC PRESSURE
AZ. COMMAND PLUS LEAD
EL. COMMAND PLUS LEAD
CONSTRUCTION OF LEAD ANGLE FROM TRUE AIRSPEED, RANGE, PARALLEX, ETC.
TEMP
LINE OF SIGHT
AZIMUTH ANGLES
AZIMUTH COMMAND
ELEVATION COMMAND
ELEVATION ANGLE
A.C. EXCITATION
POWER TO GUN
FIRING DELAY
AZ SERVO ERROR
EL. SERVO ERROR
FROM SERVO AMPL
TRIGGER
SYSTEM POWER
TURRET ANGLES
PILOT PROBE INPUT

GUN FIRE CONTROL SYSTEM

BACKGROUND OF THE INVENTION

1. Field of the Invention

This invention relates to systems for controlling the aim of a gun which is remote from the gunner.

2. Prior Art

The conventional fire control systems used on turrets in aircraft, for example, attack helicopters, depend on the gunner's estimate of the slant range. When 20 and 30mm guns, with their longer range capability, are installed on such aircraft, estimation of range becomes inadequate for two reasons. First, the gunner has all he can do to properly aim the sight during the rapidly changing dynamic situations caused by aircraft maneuvers and wind disturbances, so that the added task of mentally making a judgment as to the instantaneous slant range detracts from his tracking capability. Second, it has been shown that a gunner's ability to estimate range can easily be in error by as much as 40% and generally is about 25%. At ranges in excess of 1000 meters, such a range error produces a ballistic drop error large enough to noticeably reduce the effectiveness of the weapon system.

Conventional attempts to solve the range determination problem have used an optical stadiametric or stereoptic ranging device located on the gunner's sight, which is cumbersome for the gunner to use and inherently imprecise. Laser range finders have been used in some developmental helicopter fire control systems, mounted on an independentally gimbaled platform, and are bulky, expensive and complex.

SUMMARY OF THE INVENTION

Accordingly, an object of this invention is to provide a precise range finder of relatively low cost adaptable to use with the relatively low cost and unsophisticated fire control systems currently used on operational attack helicopters.

A feature of this invention is the provision of a lightweight small laser range finder mounted directly on the gun turret.

BRIEF DESCRIPTION OF THE DRAWING

These and other objects, features and advantages of the invention will be apparent from the following specification taken in conjunction with the accompanying drawing in which:

The FIGURE is a block diagram of an embodiment of this invention.

DESCRIPTION OF THE INVENTION

The fire control system shown in FIG. 1 accurately directs the fire of a remote turreted gun upon a distant target. A laser range finder 10 is hard mounted to the gun 12 in a turret 14 and is boresighted to the gun. The remote sight 16 is directed at the target by the gunner in the conventional manner. The lead angle is not entered into fire control solution until the gunner pulls the firing trigger, so that the laser points directly at the target and is able to measure its slant range until the trigger is pulled. When the trigger is pulled, the lead angle is entered into the fire control solution, forcing the turret to move the gun and the laser from the line of sight to the target to the appropriate line of fire. Range data is then updated during the interval of firing by integrating the air speed component along the line of sight and adding it to the last known range. After the firing burst, the lead angle is again omitted and the gun and the laser return to the line of sight.

In the preferred embodiment, the gunner's sight 16 is mounted on a pantograph 18 and provides an elevation angle signal 20 to an elevation resolver 22, and an azimuth angle signal 24 to an azimuth resolver 26, to provide an azimuth command signal 28 to one input 30 of an azimuth adder 32 and an elevation command signal 34 to one input 36 of an elevation adder 38.

The turret 14 has a drive system including an azimuth resolver 40, an azimuth motor 42 and a azimuth servo amplifier 44; and an elevation resolver 46, an elevation motor 48 and an elevation servo amplifier 50. The azimuth adder 32 provides an azimuth command signal 52 to the azimuth resolver 40 and the elevation adder 38 provides an elevation command signal 54 to the azimuth resolver 40 also, which in turn provides an elevation command signal 56 to the elevation resolver 46.

The range finder 10 comprises a 1.06 micron radiator and a receiver and provides a laser range signal 60 to a switch contact 62C1 of a three gang, two pole, gun trigger switch 62. The moving contact 62C3 passes the range signal 60 to the input 64 of a range filter 66 whose output 68 provides a filtered range signal 70 to one input 72 of the main fire control computer 74. The main computer has additional inputs receiving appropriate signals, such as 76 receiving barometer pressure, 82 receiving temperature, 86 receiving pitot pressure, 100, 101 and 102 receiving turret angle signals. The output 104 of the computer 74 provides a lead angle signal to the contact 62B2 which includes the velocity jump, etc. and is constructed from the true air speed, range, sight parallax, etc. When the trigger is not operated, the moving contacts 62A3, 62B3 and 62C3 are respectively coupled to the fixed contacts 62A1, 62B1 and 62C1. The contact 62B1 is grounded, and, therefore, when the trigger is not actuated, the additional inputs 106 and 108 of the adders 32 and 38 are grounded. When the trigger is actuated, the moving contacts 62A3, 62B3 and 62C3 are respectively coupled to the fixed contacts 62A2, 62B2 and 62C2; and therefore, when the trigger is actuated, a lead angle signal is provided from the contact 62B2 to the adders 52 and 54. While a single conductor is shown for clarity, it will be understood that this is actually a multiwire system providing three signals representing a "solid" angle.

A secondary range computer 110 has a plurality of inputs receiving appropriate signals, such as 112 receiving airspeed, 114 receiving radar altitude, and 116, 117 and 118 receiving turret angles. When the trigger is actuated, the output 120 of the computer 110 provides a predicted range signal 122 through the contacts 62C2 and 62C3 to the input 64 of the range filter 66.

A variable firing delay 130 is used to couple system power to the gun for firing the gun after the turret has been swung from the line of sight to the line of fire. System power is connected to the contact 62A2. The moving contact 62A3 is coupled to the power input 132 of the delay 130 whose power output 134 is coupled to the gun firing system, here not shown, but which may be the gun drive motor on a Gatling-type gun. As azimuth servo error signal 136 and an elevation servo error signal 138 are respectively coupled from the servo amplifiers 44 and 50 to the central inputs 140 and 142 of the firing delay 130. Subsequent to the moving contact 62A3 shifting to the contact 62A2, an initial delay, and the servo error signals falling to a predetermined minimum, the delay couples system power to the output 134.

It is contemplated that the inventive concepts herein above described may be variously otherwise embodied and combined without departing from the inventive principles included and intended to be covered by the appended claims, except insofar as limited by the prior art.

What is claimed is:

1. In a gun and fire control system having:

a gun, mounted in a turret which is aimed by a servo system, and having a firing mechanism and a trigger to fire said gun;

a remote gunner's sight for providing target elevation and azimuth signals to said servo system;

a computer for providing a lead angle signal to said servo system;

the improvement of:

a laser range finder mounted to and boresighted with said gun, for providing a real target range signal to said computer;

first means coupled to said servo system, to said computer and to said trigger for decoupling said lead angle signal from said servo system until said trigger is actuated to fire said gun, and upon said trigger being actuated to fire said gun, coupling said lead angle signal to said servo system to cause said servo system to drive said gun and said laser range finder from a line of sight orientation while said gunner's sight remains unaffected and available for continuing to provide target elevation and azimuth signals to said servo system to a line of fire orient tion.

2. In the system of claim 1 the further improveme of:

second means coupled to said trigger, to the firi mechanism of said gun and to said servo system f delaying the functioning of said firing mechanis until said servo system has driven said gun fro said line of sight orientation to said line of fi orientation.

3. In the system of claim 1 the further improvemer wherein:

said first means, upon said trigger being deactuate decouples said lead angle signal from said ser system to cause said servo system to drive said gı and said laser range finder from said line of fi orientation to said line of sight orientation.

4. In the system of claim 1 the further improveme of:

third means for providing a predicted target ran; signal to said computer;

fourth means coupled to said trigger, to said coı puter, to said laser range finder and to said thi means for coupling said real target signal to sa computer when said trigger is not actuated, and f coupling said predicted target signal to said coı puter when said trigger is actuated.

5. In the system of claim 4 the further improvemer wherein:

said third means includes means for measuring aı integrating air speed to generate said predict target range signal.

* * * * *